US006014786A

United States Patent [19]

Cachot

[11] Patent Number: 6,014,786

[45] **Date of Patent: *Jan. 18, 2000**

[54] POCKET TOOL MAGAZINE

[75] Inventor: Maurice Cachot, Delémont, Switzerland

[73] Assignee: Wenger SA, Delémont, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/991,965

[22] Filed: Dec. 17, 1997

[30] Foreign Application Priority Data

Jan. 17, 1997 [EP] European Pat. Off. ..... 97810023

[51] Int. Cl.[7] ..... B26B 11/00

[52] U.S. Cl. ..... 7/118; 81/440; 206/372

[58] Field of Search ..... 7/118, 158, 165; 206/372, 373, 376; 81/440

[56] References Cited

U.S. PATENT DOCUMENTS

| | | | |
|---|---|---|---|
| 2,980,996 | 4/1961 | Beran | 7/118 X |
| 4,285,556 | 8/1981 | Loeffel | 205/372 X |
| 5,203,469 | 4/1993 | Chang et al. | 206/372 X |
| 5,259,502 | 11/1993 | Chan | 206/372 |
| 5,511,261 | 4/1996 | Collins . | |
| 5,553,340 | 9/1996 | Brown | 7/118 |
| 5,711,194 | 1/1998 | Anderson et al. | 7/118 X |

FOREIGN PATENT DOCUMENTS

| | | |
|---|---|---|
| 1030874 | 3/1953 | France . |
| 9400187 | 5/1995 | Germany . |

*Primary Examiner*—James G Smith
*Attorney, Agent, or Firm*—Goodman & Teitelbaum, Esqs.

[57] ABSTRACT

The tool magazine has the general shape of a "Swiss knife"; it comprises essentially at least one stocking implement or blade extractable from the body, fixing means being provided on at least one face of said stocking implement or blade in order to receive a plurality of removable tools. Means being provided, on the body or on the tool, respectively, in order to provide a handle for the tool on the body.

12 Claims, 2 Drawing Sheets

POCKET TOOL MAGAZINE

This invention concerns a magazine or container for tools of sufficiently reduced dimension to be easily put into a pocket of a garment.

When it is desirable to carry around a set of tools in a pocket, there are generally two ways to do so. The first way is to use a container, generally of cylindrical shape, whose one end forms a lid and where the different tools are contained inside a hollow part of said cylinder. Generally, a tip provided at the other end of the container enables an adaptation to be made for each tool, the container then functioning as a handle for the tool being used. Such a device has several drawbacks, in particular the fact that the container must be emptied completely in order to select a particular tool since the tools are packed in a jumble inside the container. At the same time it is generally necessary to put the tools back in a predetermined order inside the container so that there is enough space for all of them. With such a device moreover it is not easy to determine whether a tool is missing.

Another way consists in joining together the different tools at one of their ends and of mounting them between two lateral sides in order to form a device of the pocket knife type or "Swiss knife" type. In this case, certain implements, for example a toothpick or tweezers, can be slipped into an adapted accommodation. When the number of implements is large, however, the knife becomes prohibitively wide. Moreover the user does not have a selection of tools suited to his needs at a particular time, the different implements being mounted at the factory by the manufacturer of the knife.

A first object of the invention is to propose a magazine for tools which does not have the drawbacks of the known devices, but instead permits easy access to a particular tool such that it is possible to take the tool out easily, put it back easily or easily check whether all the tools are there, but still maintaining pocket-size dimensions.

A second object of the invention is to propose a magazine for tools which can be adapted to suit the needs of the user, while giving the user a choice of tools to be included in the device.

These different objects are attained through a tool magazine made up of a body comprising two lateral sides surrounding an interior space, at least one implement extractable from said tool body being disposed in said space, wherein at least one of said extractable implements is shaped to receive at least one removable tool.

A preferred embodiment having two variants of the opening means for the tool magazine according to the invention is described below with reference to the attached drawing containing the figures where:

Figure 1A:
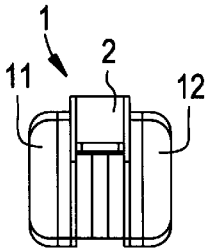
FIGS. 1A, 1B and 1C represent an embodiment of the tool magazine in the closed state, seen from one end, seen from the side, or seen from the other end, respectively.
Figure 1B:
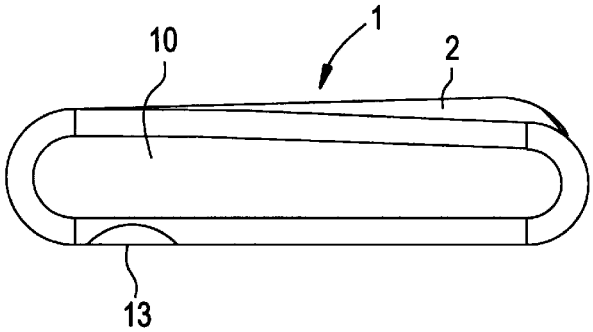
Figure 1C:
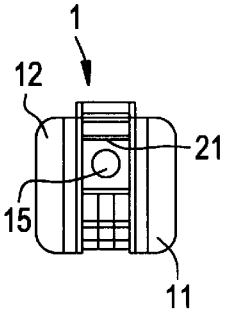

As can be seen in the figures, the tool magazine 1 according to the invention has the general shape of a "Swiss knife". From FIGS. 1A and 1C it can be seen that its dimensions, in particular its width, remain rather small. The tool magazine is thus made up of a body 10 comprising two lateral sides 11 and 12 held together in a known way and leaving a space between them. Besides a tool stocking implement 2 which will be described further below, the magazine 1 can further comprise one or more other implements or blades, for example a knife blade 13 or a punching implement 14, these other tools or implements being mounted and being usable in a known way.

Figure 2A:
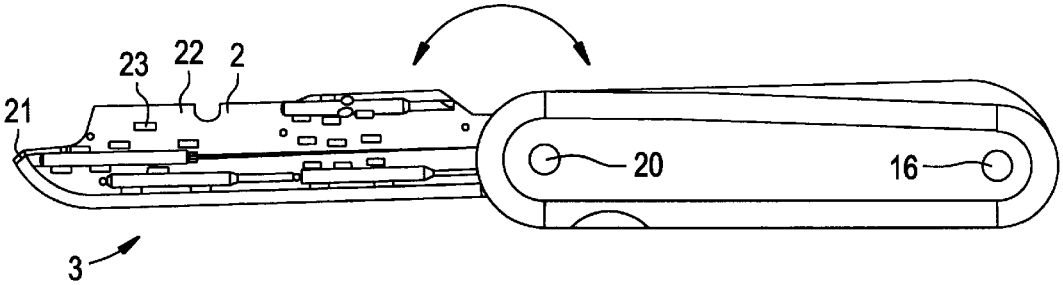
FIG. 2A is a lateral view of the same magazine, opened, according to a first variant of the opening means.

The tool magazine 1 includes a stocking implement or blade 2 disposed in the space between the two lateral sides 11 and 12 and which can be extracted from, or respectively introduced into, the body 10 according to two variants. In the case of the first variant, represented by the double arrow in FIG. 2A, a first end of the stocking implement 2 is mounted in a way so as to pivot on a pivot 20, which permits the implement to be removed from, or respectively introduced, between the two lateral sides 11 and 12 of the body 10 in the same way as an ordinary knife blade. To this end, the other end of the stocking implement 2 has grasping means 21 (see FIGS. 1C and 2A) allowing it to be seized in order to make it pivot.

Figure 4A:
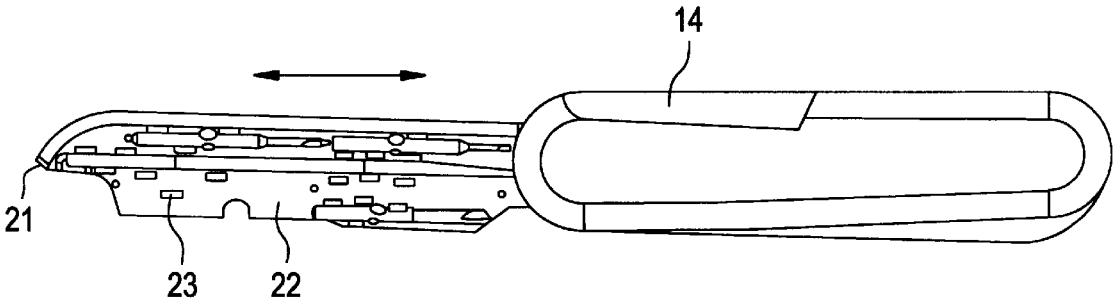
FIG. 4A is a lateral view of the magazine according to a second variant of the opening means.

According to another variant, indicated by the double arrow in FIG. 4A, the implement 2 is longitudinally sliding between the two lateral sides 11 and 12, along sliding means (not shown in the figures). The stocking implement 2 can thus be taken out of the body 10 completely and can be separated therefrom, or can be retained, by known means, in the body 10. In the same way as in the foregoing, grasping means 21 can aid in taking the stocking implement 2 out of the body 10.

Figure 2B:
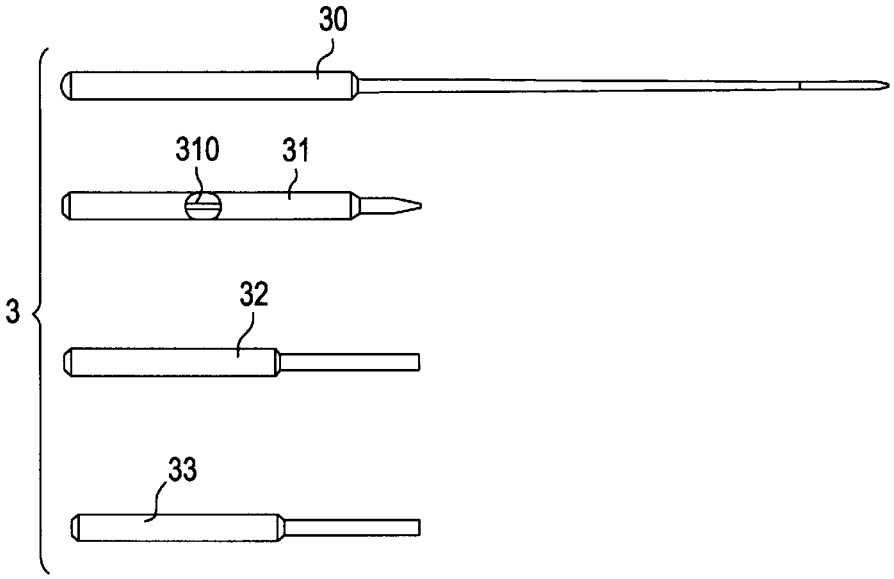
FIG. 2B shows a range of tools visible in the preceding figure.
Figure 3:
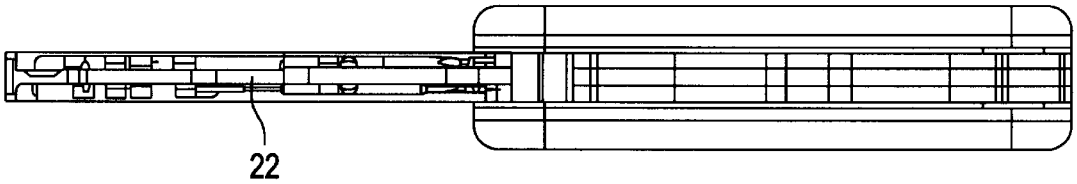
FIG. 3 shows the same opened magazine, seen from above.
Figure 4B:
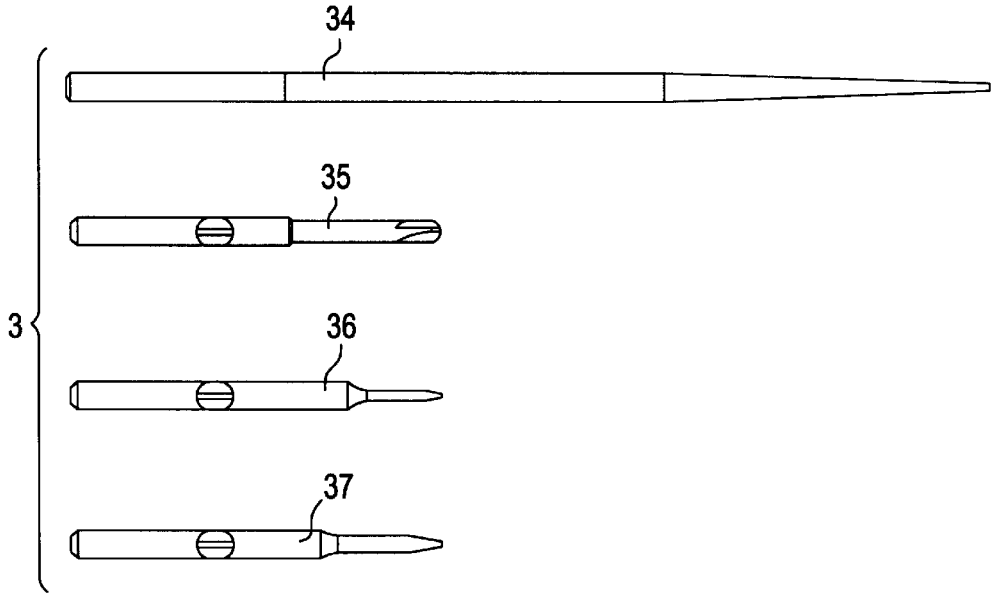
FIG. 4B shows another range of tools visible in the preceding figure.

The stocking implement 2 is made up in particular of a wall 22 having on one or both of its faces a plurality of fixing pins 23. The fixing pins 23 are preferably grouped together in such a way as to permit a plurality of tools 3 to be inserted, by pinching each between two or three pins 23. In can be seen in FIG. 2A that the face shown of the stocking implement 2 has eighteen pins 23 disposed in groups of three in such a way as to be able to stock six tools 3 parallel to one another. Although it is not absolutely necessary, the other face of the stocking implement 2 visible in FIG. 4A likewise bears the same number of pins 23 for accepting the same number of tools 3. Shown in FIGS. 2B and 4B, by way of example of the tools which can be stocked in such a device, are: a fine file 30, a first slotted screwdriver 31, two hexagonal screwdrivers 32 and 33, a needle-like implement 34, a Phillips-head screwdriver 35 and two other slotted screwdrivers 36 and 37. It is to be noted that all the tools 3 are independent from the tool magazine 1; they can therefore be easily selected by the user when buying the magazine or otherwise selected for a predetermined task from among a full range available to the user.

The tool magazine has been described with a stocking implement 2 equipped on its two faces with fixing means 23; it is evident however that it is also possible to have just one face adapted to receive tools. It is likewise possible to provide more than one stocking implement 2 between the two lateral sides 11 and 12, each of the implements being equipped with fixing pins on one or both of its faces.

A hooking means 310 can be noted on the rear portion of some of the tools, in particular on the screwdriver 31. This rear portion of the tool 31 can be inserted in an accommodation 15 which can be provided on one end of the body 10 or in an accommodation 16 which can be provided in the lateral side of the body 10. By snapping the hooking means into a known device provided for this purpose on the inside of the accommodation or accommodations 15, 16, it is possible to use the body 10 as a handle for the tool 31.

The same hooking means 310 can also be adapted, for example, to a chucking device of a tool actuator such as, for example, a battery-powered wrench or screwdriver, or to an implement powered by any other energy source.

Thus, the user has a range of tools, taking up a limited space, which tools can be adapted to his needs, the tools being easily accessible individually, and, if necessary, certain of them being easily usable in cooperation with the body of the magazine as a handle or a support of said tool.

What is claimed is:

1. A tool magazine comprising:

a body including two longitudinally extending, spaced apart, parallel lateral sides to provide an interior space therebetween, said body having a pocket knife configuration for carrying in a pocket of a garment;

means securing said lateral sides to each other in a fixed relationship;

at least one extractable implement being disposed in said interior space in an inoperable position, opposing lateral faces of a longitudinally extending wall of said at least one extractable implement being essentially parallel to said lateral sides of said body;

at least one of said opposing lateral faces of said wall being provided with fixing means for removably securing a plurality of tools to said wall when said at least one extractable implement is in said inoperable position;

said fixing means permitting said plurality of tools to be removed from said at least one of said opposing lateral faces of said wall when said at least one extractable implement is extracted from said body to an operation position; and said fixing means being a plurality of fixing pins, said fixing pins having a predetermined arrangement to permit said plurality of tools to be inserted between a selected number of said plurality of fixing pins.

2. A tool magazine according to claim 1, wherein said body is provided with pivot means to allow said at least one extractable implement to pivot out of said interior space, said pivot means including a pivot extending through one end of said at least one extractable implement, said pivot being fixed between said lateral sides of said body.

3. Tool magazine according to claim 2, wherein said at least one extractable implement includes grasping means to facilitate extraction of said at least one extractable implement from said body to said operable position.

4. Tool magazine according to claim 1, wherein said body is provided with slide means to longitudinally slide said at least one extractable implement out of said interior space to said operable position.

5. A tool magazine according to claim 1, wherein said fixing pins are provided on both of said opposing lateral faces of said wall, said fixing pins arranging said plurality of tools in a parallel relationship to each other.

6. A tool magazine according to claim 1, wherein at least one tool of said plurality of tools being provided with hooking means for securing said at least one tool in said body, said hooking means being disposed on a rear portion of said at least one tool.

7. A tool magazine according to claim 6, wherein said body is provided with accommodation means for receiving said rear portion of said at least one tool.

8. A tool magazine according to claim 7, wherein said accommodation means snaps onto said hooking means to secure said at least one tool to said body.

9. A tool magazine according to claim 7, wherein said accommodation means is disposed on an end of said body and on one of said lateral sides of said body.

10. A tool magazine according to claim 1, wherein at least a second extractable implement is disposed in said interior space of said body adjacent to said at least one extractable implement.

11. A tool magazine according to claim 10, wherein said second extractable implement is a knife blade.

12. A tool magazine according to claim 10, wherein said second extractable implement is a punching implement.

* * * * *